US008505988B2

(12) United States Patent
Hartford

(10) Patent No.: US 8,505,988 B2
(45) Date of Patent: Aug. 13, 2013

(54) APPARATUS FOR SECURING CUPBOARDS AND DRAWERS DURING AN EARTHQUAKE OR OTHER SEISMIC EVENTS AND FOR CHILD-SAFETY

(76) Inventor: Wayne Hartford, Santa Clarita, CA (US)

( * ) Notice: Subject to any disclaimer, the term of this patent is extended or adjusted under 35 U.S.C. 154(b) by 758 days.

(21) Appl. No.: 12/418,610

(22) Filed: Apr. 5, 2009

(65) Prior Publication Data

US 2010/0253097 A1 Oct. 7, 2010

(51) Int. Cl.
*E05C 3/16* (2006.01)

(52) U.S. Cl.
USPC ..... 292/230; 292/130; 292/239; 292/92; 292/DIG. 65

(58) Field of Classification Search
USPC ..... 292/230–239, 130–136, 21, 92, DIG. 65
See application file for complete search history.

(56) References Cited

U.S. PATENT DOCUMENTS 4,909,571 A 3/1990 Vidwans
4,988,134 A 1/1991 Vidwans
5,035,451 A * 7/1991 Brady ..... 292/96
5,042,856 A 8/1991 Goodman
5,090,753 A 2/1992 Goodman
5,152,562 A 10/1992 Stevenson
5,201,434 A 4/1993 Mariano
5,224,744 A 7/1993 Michelutti
5,312,143 A 5/1994 Buckner
5,370,440 A 12/1994 Rogala
5,415,314 A 5/1995 McCollum
5,419,598 A 5/1995 Kreitzer
5,474,341 A 12/1995 Putman
5,518,282 A 5/1996 Sawada
5,529,352 A 6/1996 Chin
5,570,914 A 11/1996 Hughes
5,597,188 A 1/1997 Miche
5,611,579 A * 3/1997 Kreitenberg ..... 292/130
5,697,655 A 12/1997 Strong
6,550,827 B1 4/2003 Tsujino
6,619,706 B2 9/2003 Mackie
6,942,257 B2 * 9/2005 Wong et al. ..... 292/128

* cited by examiner

*Primary Examiner* — Carlos Lugo
*Assistant Examiner* — Mark Williams
(74) *Attorney, Agent, or Firm* — Law Office of David Hong

(57) ABSTRACT

There is an apparatus for securing the cover for cabinet, cupboard or drawer during movement from an earthquake with a housing with a pivoting latch arm, which freely rotates around an axle, from a first upright position to a second prone or locked position; the pivoting latch arm engages a receiving piece in the second prone position. This device also serves a child safety device.

8 Claims, 6 Drawing Sheets

APPARATUS FOR SECURING CUPBOARDS AND DRAWERS DURING AN EARTHQUAKE OR OTHER SEISMIC EVENTS AND FOR CHILD-SAFETY

BACKGROUND OF THE INVENTION

1. Field of the Invention

This invention relates to an apparatus for securing cupboards and drawers during an earthquake or other seismic events. This invention also relates to a child-safety device.

2. Description of Related Art

Prior to the present invention, to prevent cupboard covers or drawers from opening during the shaking due to an earthquake or other seismic event, most people install child proof locks or hooks, which connect the inner surface of the cover or drawer to the inner shelf or inner cupboard cavity.

The biggest problem with the child proof locks, hooks or magnetic attachments is their inconvenience. To open a child proof hook-type closure, the user has to reach inbetween the cupboard cover and the inside of the cavity or hold a magnet to the outside face of the cover to release the latch. These existing products can be quite annoying, especially when there are no children present to protect. Some of these devices require a barbed-like hook to be mounted to the cupboard cover, which can present a hazard to the user.

There are two significant drawbacks to the contents of a cupboard emptying on a floor during an earthquake; first, you lose the things that you need everyday like eating utensils and food stuffs, which you will need after an earthquake; second, broken items on the floor present a real hazard, especially if the earthquake happens at night, a subsequent power failure and no emergency lighting.

Earthquakes do not always produce significant motion in all directions but instead can be dominated by motion in a single direction. Current anti-earthquake cupboard devices appear to only be responsive to horizontal movement, and do not consider the other types and angles of movement during an earthquake or seismic event. Nor do these existing devices consider that displacement or shifting of cupboard contents resulting from other motions can also cause the cupboard covers to open.

From the preceding descriptions, it is apparent that the devices currently being used have significant disadvantages. Thus, important aspects of the technology used in the field of invention remain amenable to useful refinement.

SUMMARY OF THE INVENTION

In accordance with the invention, one of the purposes of this invention is to provide a simple and convenient solution for securing the cupboard cover door or the drawer to the inside of the cupboard or drawer, only when there is an earthquake or seismic event.

This invention also allows for easy adjustment to tailor the apparatus to the mounting surface in order to allow for proper triggering during an earthquake or seismic event. This invention employs point contact versus line contact in allowing for a self-correcting and aligning apparatus.

The invention provides a pivoting latch arm, wherein the first or unlocked position is inherently unstable, which is exactly what you want to allow for triggering of the latch or locking mechanism (i.e., the pivoting latch arm to move from the first position to the second position) due to the shaking of the surface due to an earthquake. This invention is further responsive or sensitive to almost all directions of motion. The device is self leveling over a reasonable range. This invention is easy to manufacture and easy to install. This invention will make a good child resistant lock and a great earthquake latch.

The present invention introduces such refinements. In its preferred embodiments, the present invention has several aspects or facets that can be used independently, although they are preferably employed together to optimize their benefits. All of the foregoing operational principles and advantages of the present invention will be more fully appreciated upon consideration of the following detailed description, with reference to the appended drawings.

PARTS LISTING

Figure 1:
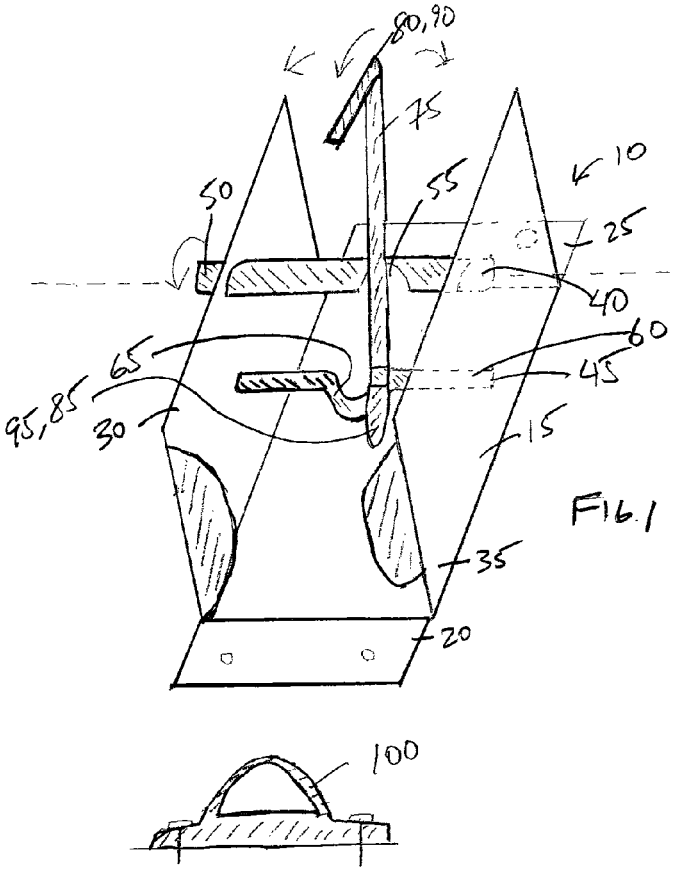
FIG. 1 is a view of one embodiment of the invention, which shows a perspective overview of the apparatus, in the first or unlocked position.

10 apparatus
15 housing
20, 25 feet for mounting
30 first vertical member
35 second vertical member
40 top opening on each vertical member for the adjustable support piece
45 bottom opening on each vertical member for the axle
50 adjustable support piece
55 radial groove on the adjustable support piece
60 axle or crossarm
65 bend in axle, centrally located, acts as a secondary pivot point
70 holes or slots for axle in the walls of the vertical members
75 pivoting arm or latch
80 first end of pivoting arm
85 second end of pivoting arm
90 hook or male end of pivoting arm

95 loop on second end of pivoting arm
100 receiving piece with opening head (usually attached or screwed into facing cabinet or door surface)
105 stop clip
110 V-shaped indentation on stop clip
115 latch arm support
120 groove in latch arm support
125 front flaps on vertical support members or walls
130 tabs or ears on top of vertical members or walls
135 slots on vertical support walls
140 opening or channel at rear of housing

DESCRIPTION OF THE PREFERRED EMBODIMENTS

Referring to FIGS. 1-10, there is illustrated an apparatus for securing a cupboard cover or drawer during an earthquake or other seismic event. The most basic parts of this apparatus are a body, a pivoting latch arm, an axle, and a receiving piece.

Housing or Body:

There is a housing or body, which has two vertically facing members or sides and a bottom surface. The housing also has feet to provide a surface for mounting the apparatus to the cupboard or drawer surface. The apparatus can be mounted to a cabinet or drawer surface with any type of attachment device, including but not limited to hook and loop devices (Velcro), glue, screws or bolts.

The two vertical members or walls preferably mimic each other in shape and lie in a generally parallel orientation with respect to one another. Additionally, the front or first sides of the members gently curve or are bent inwards towards the center line of the housing to act as a guide for the latch arm to fall directionally towards the intended target of the loop of the receiving piece.

There can be multiple openings on each vertical member, which allow for an adjustable support piece and an axle. As shown in the figures, there is a top opening and a bottom opening.

The housing can be stamped from a single piece of metal or alloy material. Also, other versions could use plastic, other formable materials, recycled wood fiber materials or bamboo.

Adjustable Support

Generally near the top or near the upper half of the apparatus, the vertically facing member or sides have an adjustable support that connects the two vertical members. This adjustable support has a divot or groove, which forms a receiving bay for the latch arm.

Figure 3:
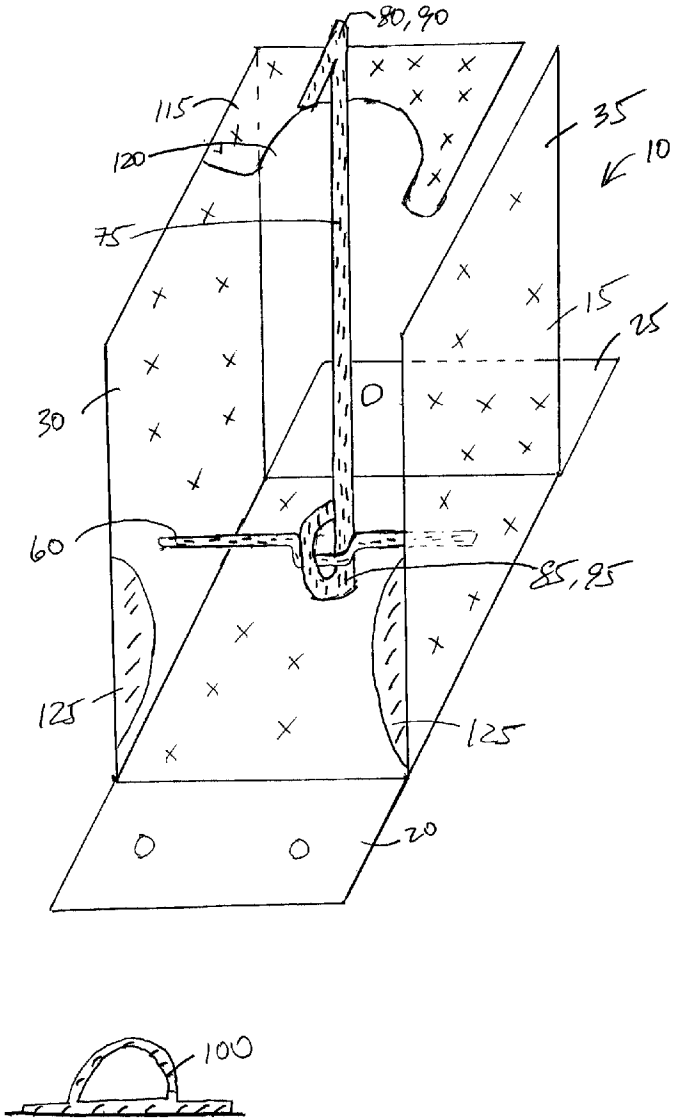
FIG. 3 shows another embodiment of the invention, in the first or unlocked position.
Figure 6:
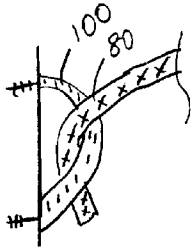
FIG. 6 shows the hook end of the apparatus engaging the receiving or screw hole, which is mounted on a wall or inside surface of the drawer, cabinet or cupboard.

As shown in FIG. 3, in other embodiments, instead of a separate structure, such as the vertically facing member, there can also be a support member or latch arm support that is integral with the housing or one of the vertical members and bent perpendicularly to the plane of the vertical member. This support member can also have a groove or divot that freely engages the latch arm and further allow free movement of the latch arm.

As shown in FIG. 3, this integrated upper support, which can allow for the translation of longitudinal motion, is now incorporated into the frame; the axle provides enough room for adjustment that one might need for mounting on different angled surfaces. Also, by optimizing the "V" shape or depth of the bend in the axle, the length of the hook can be optimized.

Axle

Located below and underneath and at a lower elevation of the adjustable support, there is an axle that is mounted between the vertical walls of the housing and is relatively perpendicular to the vertical members. This axle has a centrally located bend, which is at a lower elevation than the terminal ends of the axle. Further, this central bend in the axle can be "V" or "U" shaped or another usable shape. This bend in the axle allows the second or loop end of the latch arm to freely pivot and move within the vertical members.

Figure 2:
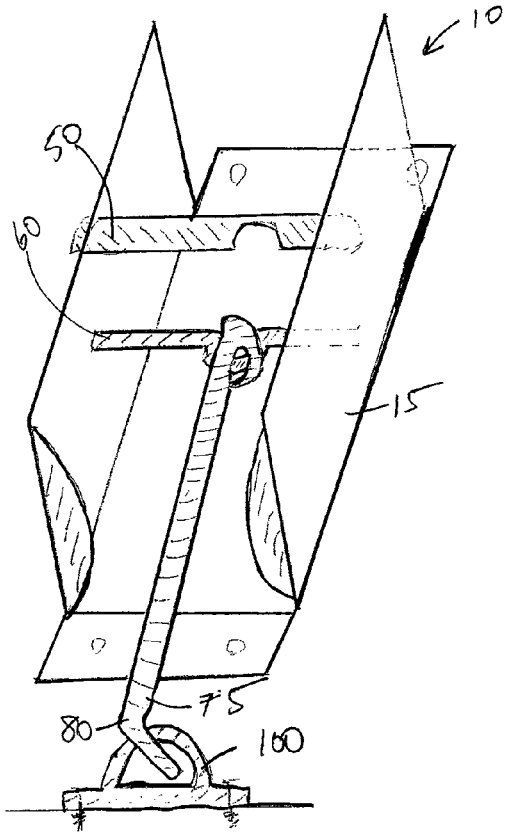
FIG. 2 shows the invention of FIG. 1 in the second or locked position.

In FIG. 1-2, the "V" shaped axle makes the apparatus all but automatically adjust for minor misalignment with respect to gravity when mounting. As a result, in other possible embodiments, the "second pivot" will become fixed, and a curved support may possibly be incorporated into the housing.

Further, the "V-shape" in the axle or the length of the second end of the latch arm can also be adjusted to be deeper (or longer) in order to provide additional degrees of freedom for the pivoting latch arm; the axle will act as a "crankshaft". Between the deep "V-shape" and an elongated loop at the end of the hook around the axle, there will be sufficient axial play to open the door and reset the hook.

Figure 4:
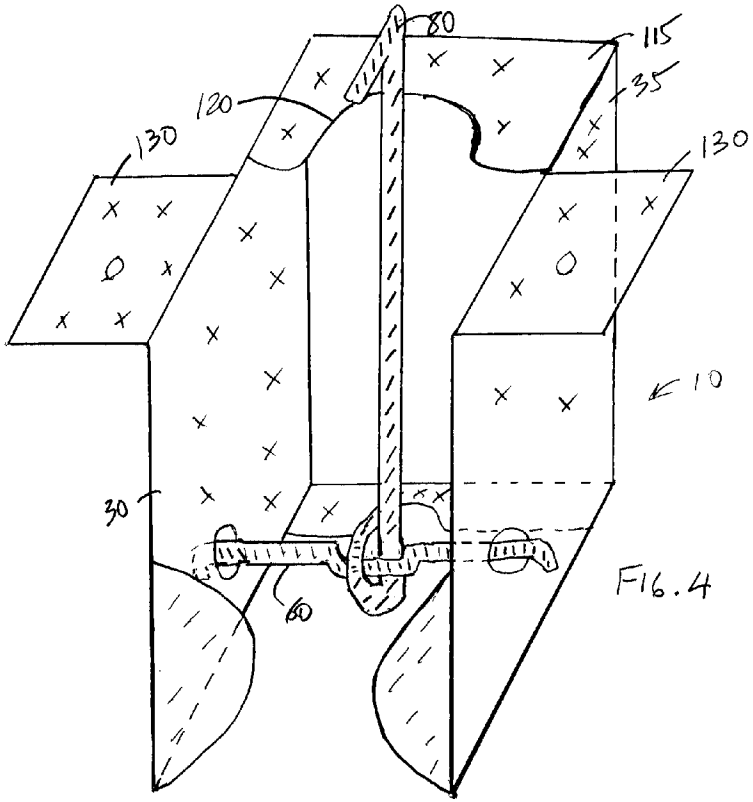
FIG. 4 shows another embodiment of the invention, in the first or unlocked position; there are mounting ears on the top portion of the device; this third embodiment can be mounted to the top or bottom of a surface within a defined space like a cupboard or a drawer.

In the embodiment shown in FIG. 3, the axle is bent; however this invention allows for both straight and bent axles for maximum flexibility of use; although a bent axle is preferred. FIG. 4 shows the axle having a bend or a centrally located portion, which has a lower elevation than the terminal ends of the axle. The axle and the latch arm are made from wire or round stock, which helps establish the "point contact" between the members.

Point of Contact:

The bend or "V-shape" of the central part of the axle and also the radial groove on the adjustable support piece help the invention to take advantage of engagement of the latch arm and the axle and also between the latch arm and the radial groove on the adjustable support piece or the upper horizontal portion of the vertical member. With "point of contact" engagement of the parts, the invention can allow for a greater degree of movement than if there was simply line contact.

Latch Arm:

The pivoting latch arm has a first arm end and a second arm end; the first arm end has a hook type end, which engages the loop end of the mounting screw. The second arm end has a loop, which freely rotates around the bent portion of the axle.

Due to this "point contact" of the second arm end loop with the bent portion of the axle, the latch arm can pivot along a multitude of different angles, including forwards/backwards and side to side.

During a seismic event, this latch or locking arm can have longitudinal movement within the divot or groove of the adjustable support, which in turn allows the latch arm to destabilize from the vertical or first or unlocked position to a horizontal or second or locked position and for the first end or hook of the latch arm to engage the loop end of the receiving piece.

Receiving Piece:

There is a receiving screw or receiving structure with a first end and a second end. The first end is typically a screw end, but this first end can also be a glued or adhesive surface end. The second end is the receiving end and typically a loop head, but other shaped receiving areas can be used. The first end of the latch arm will engage the receiving area of the screw.

Other Embodiments

Instead of a male/female connection of the hook end of the latch arm and the receiving end of the receiving screw, this invention can also employ other types of secure but removable connections, including but not limited to magnets and hook/loop (Velcro brand attachment).

Figure 7:
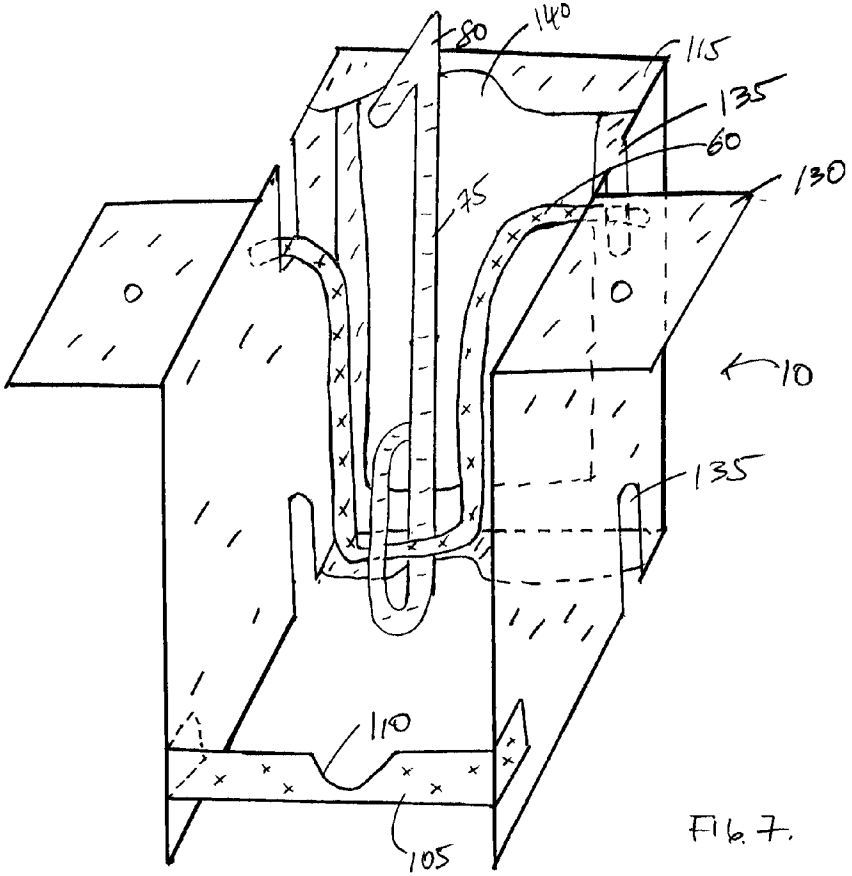
FIG. 7 shows another embodiment of the invention, which can be both an anti-seismic device or a child-safety lock; this fourth embodiment can be mounted to the top or bottom of a surface within a defined space like a cupboard or a drawer. Note that in FIGS. 4 and 7, the tabs 130 can be placed at a higher elevation than the rest of the housing; this higher elevation allows the hook end 80 of the latch arm to freely move when the invention is "top mounted" to the bottom of a surface within a defined space (like a cupboard or drawer).
Figure 8:
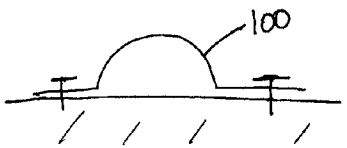
FIG. 8 shows another receiving member, which has a loop or opening for receiving the first end of the locking arm.

Top Mounted Version (FIGS. 4 and 7):

FIGS. 4 and 7 show a top mounted version of the invention, which has mounting ears on the top portion of the apparatus.

In one preferred embodiment, there are mounting flaps, ears or surfaces, which arise from the vertical members. This embodiment allows for mounting at the top surface of a cabinet or the bottom of a shelf, which allows the user to fully exercise the lower portion of a cabinet or shelf surface.

Instead of a hole in the vertical members for the axle as in FIG. 1-2, there are vertical slots in the vertical walls of the housing, which allow the axle to move to the top or bottom depending on gravity. The mounting feet are now on the sides of the vertical members instead of the ends of the housing. Furthermore the mounting feet are configured such that the entire housing sits above the mounting surface, as if on short stilts. This allows for a support piece to be located at both the top and bottom of the housing; there is also clearance for the hook end of the latch arm, which makes the whole apparatus completely reversible (i.e. top and bottom surface mounting capability).

The axle will have small bends at the terminal axle ends, which will slip through the slot or vertical member openings, when aligned properly, but these slots or openings prevent the axle from falling out or disengaging from the housing.

Some Manufacturing Thoughts:

The inventor proposes that the user will slip the axle into the housing through the hook of the pivot arm when installing the apparatus in a cupboard or drawer. Several embodiments of the apparatus uses a one piece stamping and wire formed parts and a nylon receiving piece to mount to the door; this invention is very inexpensive to manufacture, and now, the unit can be mounted on the bottom of a shelf or top of the cabinet where it will not take up any shelf space or be in the way.

Figure 5:
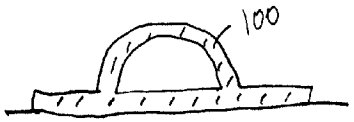
FIG. 5 shows a receiving member, which has a loop or opening for receiving the first end of the locking arm.

FIG. 5 shows the receiving member with a receptacle or opening to receive the hook end of the apparatus. This receiving member can be attached to any surface with a screw, bolt, adhesive, and/or hook and loop attachments.

Third and Fourth Embodiments: Double Mounted Versions

FIGS. 4 and 7 show other versions of the invention that allow for mounting either above or below a mounting surface. There is a housing with two vertical members, which is similar to the above two previous versions; however, the vertical members are connected via a central portion located in the back of the apparatus. This is slightly different in the earlier embodiments that had a central meeting portion at the bottom of the unit.

This universal mounted version can be stamped from a single piece of sheet metal or alloy, and plus, a couple of wire form parts.

A. Top of Double Mount Version

The top of the double mount version has ears or flaps that arise from the vertical portions of the housing. These top ears are relatively perpendicular to the vertical portions so that these ears or flaps can provide a contact and mounting surface to the top of a shelf or area.

The rearward portions of the apparatus at the top and bottom of the unit have support portions that extend partially within the housing but have a concave or groove or bay area, which will help support the rotating latch arm in the first or unlocked position, when either mounted on the top or bottom of a surface.

In FIG. 4, the terminal ends of the axle will be a bit tighter and extend a bit further over the outer edges of the vertical members and through the opening for the axle than what is shown in the FIG. 4. Also, in the middle area, the axle has a groove or concave area, which helps in point contact and to allow more free movement of the "loop" or second end of the pivoting latch arm.

FIG. 4 shows the tabs or ears having the same elevation as the rest of the top portion of the device; however, other embodiments allow for different elevation of the tabs, namely a higher elevation of the tabs than the rest of the apparatus to allow for the "bottom mounting" position and for the first or hook end of the pivoting lever arm to be able to assume the first unlocked position and swing to the second locked position.

Figure 9:
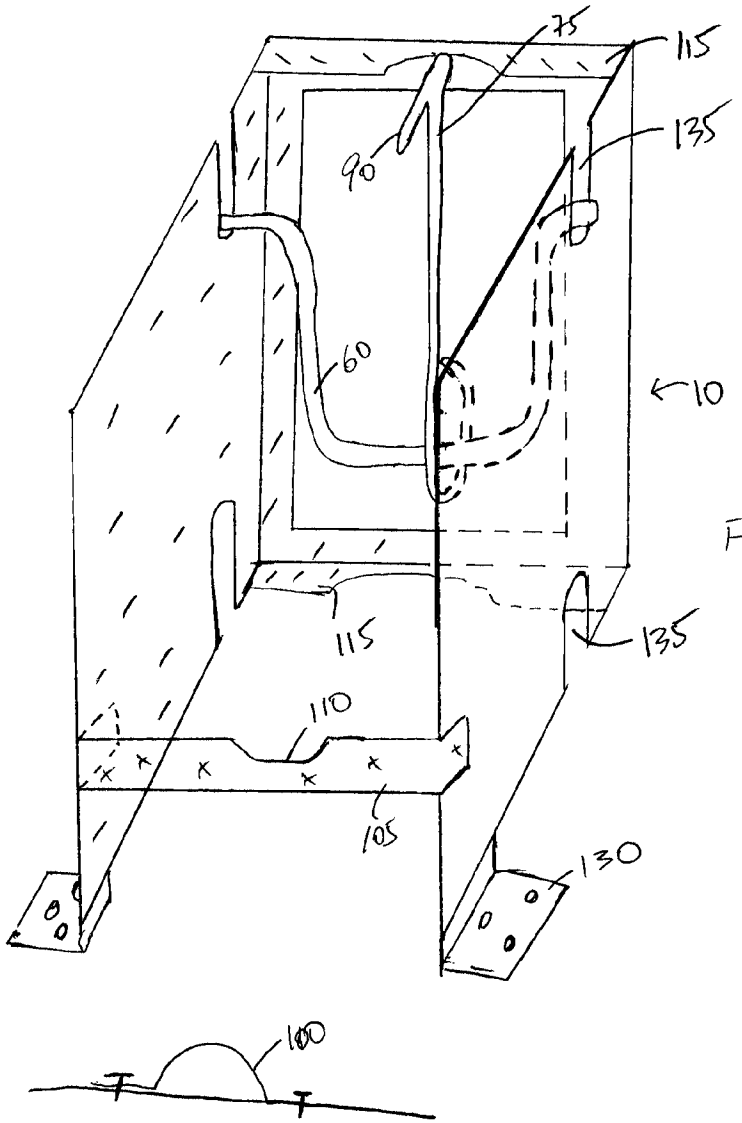
FIG. 9 shows the embodiment shown in FIG. 7 in the opposite or alternative mounting position and the first or unlocked position.
Figure 10:
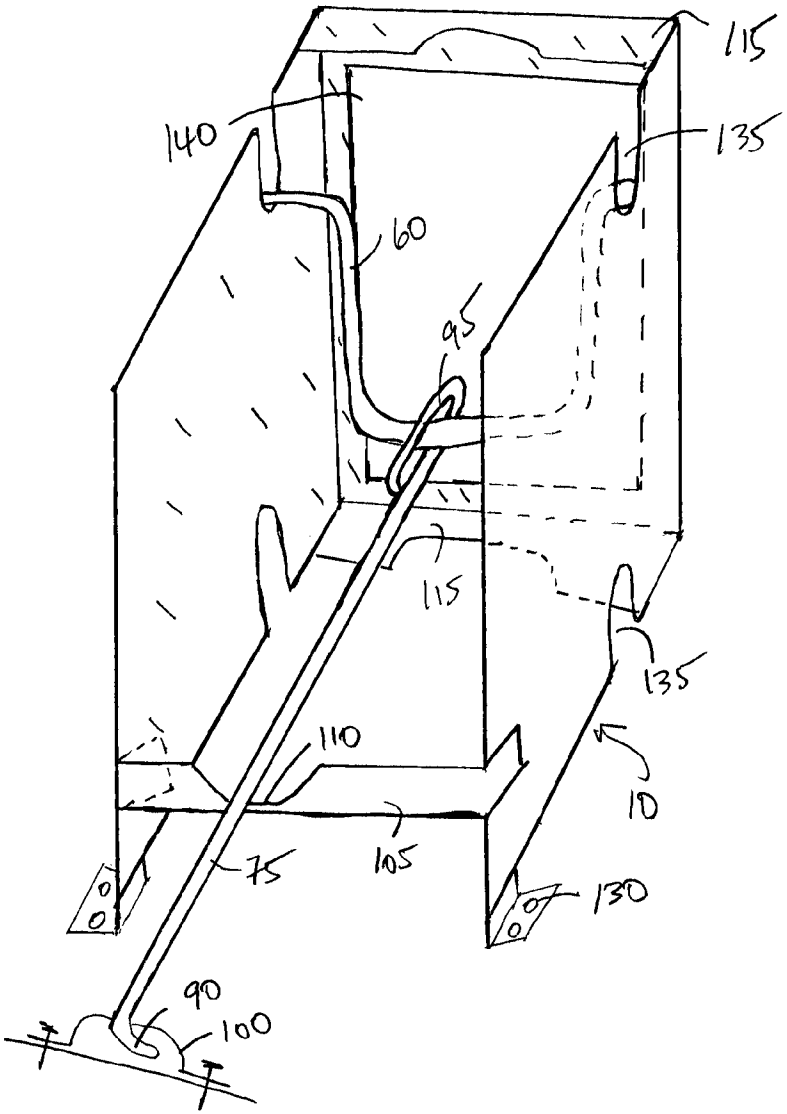
FIG. 10 shows the embodiment shown in FIG. 9 in the second or locked position.

FIG. 7—Child Proof Lock and Anti-Seismic Device: FIGS. 7, 9 and 10 show another preferred embodiment of invention, namely a child-proof lock and anti-seismic device for cupboards and drawers. The main differences with between the third (FIG. 4) and fourth embodiments (FIG. 7) are:

a. Stop Clip, which supports the pivoting latch arm (when the latch arm assumes a second or locked position after seismic movement or after the latch arm is moved forward and downwards from its first or unlocked position); the stop clip structure has a first or top end and a second or bottom end; the top of the stop clip structure has a generally "V-Shaped" or "U-Shaped" indentation, which is located generally central; this "V-Shaped" indentation helps guide the pivoting latch arm towards the center and towards the receiving structure. Further, this "V-Shaped" indentation helps align the pivoting latch arm within the device and to prevent the whole device from mis-alignment. Of course, other indentation shapes can be used besides U or V shapes. This stop piece is typically sheet metal or other malleable materials (including plastics), which is bent in a clip or "C-Shape" that can be slid over the outer sides of the vertical members. This "stop piece" or clip can also help push the two vertical members towards the center line of the apparatus. This "stop piece" or clip can be removed and realigned upside down, when the user wants to mount the device in the alternative position. This is quite useful since this apparatus allows for mounting both top and bottom in a closed space.

b. Longer and more pronounced axle or bend in the axle or crossbar;

c. Longer and more pronounced loop end or second end of the latch arm.

d. Open faced channel or opening in the rear portion of the apparatus; this open faced channel allows the more pronounced and longer loop end of the second end of the latch arm to move backwards and forwards during the releasing of the hook end from the receiving piece; FIG. 7 shows a rather large opening, but other sized openings can be employed.

This version of the invention acts as an anti-seismic device, but also allows the apparatus to be used as a child-resistant or child-proof lock for cupboards or drawers. The nice thing about this fourth embodiment is that the child proof lock will not activated until the user put the latch arm into the second or locked position or due to seismic activity. This is an improvement over child safety devices, which are always locked or securely engaged.

Note that other versions of the device shown in FIG. 7 may not require the need for the "stop clip" because the front of the vertical members may have additional wings or tabs, which are oriented or bent relatively perpendicular to the plane of the vertical members. These wings or tabs would be sloped so that the other sides create a wider opening, but as one gets closer to the middle of the wings, the opening gets much smaller in width. Similar structures can be seen in FIG. 1-3.

FIG. 7 shows a housing with a first (top) end, a second (bottom end), a third (front) end, and a fourth (back) end; there are two vertical upright structures or walls that are interconnected at the rear end of the housing; there is also a channel that runs from the top end to the bottom end, but still allows for connection of the two vertical members or walls. Near the front and top end of the housing, and at a higher elevation than the rest of the housing, there is at least one tab or ear, which is bent or oriented relatively perpendicular to the vertical wall members. These tabs or ears allow the top end of the apparatus to be mounted to the bottom surface of a shelf or horizontal cupboard partition. Positioned near or right behind the tabs, there are at least one slot on each vertical member or wall; there is at least one slot on each of the top and bottom ends of the device; these slots allows for the axle or crossbar with deep offset to pivotally engage and rotate within said slots. The crossbar has a much elongated offset area, which is similar to a U or V shape (note that this shape is only for illustration and can be various other arbitrary shapes). This offset area is generally central to the crossbar structure; the bottom of the offset is at a lower elevation in comparison to the terminal ends of the crossbar structure; these terminal ends of the crossbar will pivotally engage or rotate within the slots in the vertical member walls. This crossbar or cross member is similar to a crankshaft when used in conjunction with the second end of the pivoting locking arm. The hook or latch arm has a first end and second end; the second end or loop end has a much longer and more pronounced area within the loop, which will allow the locking or latch arm to move backwards and forwards along the horizontal plane of the apparatus, when the locking or latch arm is in the second or locking position. There is a stop clip structure with a first or top clip end and second or bottom clip end; the top clip end has a "V-Shaped" groove, which helps keep the locking or latch arm correctly positioned during operation and to allow the locking or latch arm to better orient for engaging the receiving loop, which is mounted on the inside of the cupboard or drawer.

Guides for the Top End of the Locking or Latch Arm:

At the top and bottom ends of the apparatus, there are also grooved structures, which help guide or hold the first or hook end of the locking arm in the first position. These grooved positioning structures can be made from the same piece of material as the rest of the housing and are bent or molded into a relatively perpendicular orientation to the vertical walls of the housing.

How to Use the Invention:

The user should mount the apparatus near the opening edge of the door and farthest away from the hinge side. The apparatus can be mounted on one of the bottom surfaces of the cupboard or any shelf within the cupboard. For the embodiments in FIGS. 4 and 7, the apparatus can also be mounted on both the top and bottom surfaces of any shelf within the drawer or cupboard. The receiving screws should be optimally placed so that the latch arm can freely engage the receiving area of the screw. The embodiment of FIG. 4 is mounted to the top inner surface of an area to be protected (i.e., top surface of a cabinet). Further, the embodiment shown in FIG. 4 can be attached to a mid-level area of an enclosed area (like the bottom of the middle shelf of a cabinet).

How to Disengage the Apparatus:

Due to the elongated loop at the end of the hook around the axle, there will be plenty of axial play to open the door and release the hook end and to lift the latch arm back to the first position.

How to Disengage the Child-Lock in FIG. 7:

Since the second end of the pivoting latch arm and also the axle or "cross-bar with deep offset" structures have elongated structures, when the latch arm is in the second or locked position, there is a measured amount of room along the horizontal axis of the device to allow the latch arm to move forwards and backwards, which allows the user to open the locked door a measured amount or distance to allow the user to stick his/her finger and to disengage the apparatus' pivoting latch arm the receiving structure or loop head.

An apparatus for securing a cover for a defined area during movement from an earthquake comprising: a housing with a front end and a rear end; the housing has two vertical upright walls that are interconnected at the rear end of the housing; the rear end of the housing has an opening; near the front end of the housing and at a higher elevation than the rest of the housing, there is at least one tab, which is bent or oriented relatively perpendicular to the vertical upright walls; said at least one tab allows the first end of the housing to be mounted to a first surface within said defined area; each vertical upright wall has at least one slot; a crossbar pivotally engages and rotates within said at least one slot of said vertical upright walls; a latch arm has a first latch end and a second latch end; the second latch end rotatably engages the crossbar; a clip structure engages the front end of the housing and the vertically upright walls; the clip structure has a centrally located clip groove; and a receiving member, which is mounted on a second surface within the defined area; whereby upon movement of the first mounting surface, the first end of the latch arm moves from a first unlocked position to a second locked position; in the second locked position, the first end of the latch arm engages the receiving member, which secures the cover for a defined area during movement from an earthquake.

An apparatus for securing a cover for a defined area during a movement from an earthquake comprising: a housing, which has a first vertical housing member and a second vertical housing member and a central housing member; a central housing member connects the first and the second vertical members; the first and the second vertical members have a top end and a bottom end and an opening between the top end and bottom end; at the top end of the vertical members of the housing, there is a latch arm support, which is oriented relatively perpendicular to the first and the second vertical housing members; a pivoting latch arm with a first latch arm end and a second latch arm end; an axle is positioned between the first and the second vertical members; the housing is mounted to a first mounting surface; a receiving structure, which is mounted to a second mounting surface; the second latch arm end is able to freely rotate around the axle from a first position to a second position; the first end of the latch arm is able to engage the latch arm support in the first position; the first end of the latch arm is able to engage the receiving piece in the second position; whereby said seismic movement causes the pivoting latch arm to move from the first position and to the second position and to engage said receiving piece and to secure the cover for a defined area during a movement from an earthquake; the axle has a centrally located bent portion; the latch arm support has a groove; the receiving piece has a loop-shaped receiving area for the first latch arm end; the central housing portion has at least one tab structure, which can be engaged to the interior surface of the interior space; the first ends of the first and second vertical members have at least one surface engagement tab.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

Any element in a claim that does not explicitly state "means for" performing a specific function, or "step for" performing a specific function, is not be interpreted as a "means" or "step" clause as specified in 35 U.S.C. Sec. 112, Paragraph 6. In particular, the use of "step of" in the claims herein is not intended to invoke the provisions of 35 U.S.C. Sec. 112, Paragraph 6.

I claim:

1. An apparatus for securing a cover for a defined area, said area moving during movement from an earthquake, the apparatus comprising:

a housing with a front end and a rear end;

the housing has two vertical upright walls that are interconnected at the rear end of the housing;

near the front end of the housing, there is at least one tab, which is bent or oriented relatively perpendicular to the vertical upright walls; said at least one tab allows the first end of the housing to be mounted to a first surface within said defined area;

each vertical upright wall has at least one slot;

a crossbar rotates within said at least one slot of said vertical upright walls;

the at least one slot is larger than the cross-sectional width of the cross-bar;

the crossbar extends across the width of the two vertical upright walls;

a latch arm has a first latch end and a second latch end; the second latch end rotatably engages the crossbar; and a receiving member, which is mounted on a second surface within the defined area;

whereby upon movement of the first surface, the first end of the latch arm moves from a first unlocked position to a second locked position; in the second locked position, the first end of the latch arm engages the receiving member, which secures the cover for a defined area during movement from an earthquake.

2. The apparatus of claim 1 wherein the rear end of the housing has an opening.

3. The apparatus of claim 1 wherein the at least one tab is at a higher elevation than the vertical upright walls of the housing.

4. The apparatus of claim 1 wherein a clip structure engages the front end of the housing and the vertically upright walls; the clip structure has a centrally located clip groove.

5. An apparatus for securing a cover for a defined area, said area moving during movement from an earthquake, the apparatus comprising:

a housing, which has two vertical upright walls that are interconnected;

the housing has at least one tab, which is oriented relatively perpendicular to the vertical upright walls; said at least one tab allows the housing to be mounted to a first surface within said defined area;

each vertical upright wall has at least one slot;

a crossbar rotates within said at least one slot of said vertical upright walls;

the at least one slot is larger than the cross-sectional width of the cross-bar;

the crossbar extends across the width of the two vertical upright walls;

a latch arm has a first latch end and a second latch end; the second latch end pivots around the crossbar and at a multitude of different angles; and a receiving member, which is mounted on a second surface within the defined area;

whereby upon movement of the first surface, the first end of the latch arm moves from a first unlocked position to a second locked position; in the second locked position, the first end of the latch arm engages the receiving member, which secures the cover for a defined area during movement from an earthquake.

6. An apparatus of claim 5, wherein the housing has two tabs.

7. An apparatus for securing a cover for a defined area, said area moving during movement from an earthquake, the apparatus comprising:

a housing, which has two vertical upright walls that are interconnected;

the housing has at least one tab, which allows the housing to be mounted to a first surface within said defined area;

each vertical upright wall has at least one slot;

a crossbar rotates within said at least one slot of said vertical upright walls;

the at least one slot is larger than the cross-sectional width of the cross-bar;

the crossbar extends across the width of the two vertical upright walls;

a latch arm has a first latch end and a second latch end; the second latch end pivots around the crossbar and at a multitude of different angles; and a receiving member, which is mounted on a second surface within the defined area;

whereby upon movement of the first surface, the first end of the latch arm moves from a first unlocked position to a second locked position; in the second locked position, the first end of the latch arm engages the receiving member, which secures the cover for a defined area during movement from an earthquake.

8. An apparatus of claim 7, wherein the housing has two tabs.

* * * * *